US009653193B2

(12) United States Patent
Windrich et al.

(10) Patent No.: US 9,653,193 B2
(45) Date of Patent: May 16, 2017

(54) COATING METHOD AND COATING FOR A BEARING COMPONENT

(75) Inventors: Juergen Windrich, Leimen (DE); Tim Matthias Hosenfeldt, Nuremberg (DE); Helmut Schillinger, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 127 days.

(21) Appl. No.: 14/124,197

(22) PCT Filed: Apr. 17, 2012

(86) PCT No.: PCT/EP2012/056996

§ 371 (c)(1),
(2), (4) Date: Feb. 12, 2014

(87) PCT Pub. No.: WO2012/167981

PCT Pub. Date: Dec. 13, 2012

(65) Prior Publication Data

US 2014/0147598 A1 May 29, 2014

(30) Foreign Application Priority Data

Jun. 7, 2011 (DE) ..... 10 2011 077 023

(51) Int. Cl.

| | |
|---|---|
| ***B05D 3/00*** | (2006.01) |
| ***H01B 3/42*** | (2006.01) |
| ***B05D 5/08*** | (2006.01) |
| ***H01B 3/44*** | (2006.01) |
| *B05D 3/06* | (2006.01) |

(52) U.S. Cl.
CPC ..... *H01B 3/427* (2013.01); *B05D 5/08* (2013.01); *H01B 3/445* (2013.01); *B05D 3/06* (2013.01); *B05D 5/083* (2013.01)

(58) Field of Classification Search
CPC . B05D 5/08; B05D 5/083; B05D 3/06; H01B 3/445; H01B 3/427
USPC ..... 427/508, 553
See application file for complete search history.

(56) References Cited

U.S. PATENT DOCUMENTS

| | | | | |
|---|---|---|---|---|
| 5,977,213 | A * | 11/1999 | Mahmud et al. | 523/351 |
| 6,121,130 | A * | 9/2000 | Chua et al. | 438/623 |
| 7,153,892 | B2 * | 12/2006 | Ramsey | 522/8 |
| 2005/0025977 | A1 | 2/2005 | Adam et al. | |
| 2006/0211802 | A1 * | 9/2006 | Asgari | A61L 27/04 524/439 |
| 2008/0085416 | A1 * | 4/2008 | Nagato et al. | 428/422 |

FOREIGN PATENT DOCUMENTS

| | | |
|---|---|---|
| DE | 101 47 292 | 10/2007 |
| WO | WO 2008/119600 | 10/2008 |

* cited by examiner

*Primary Examiner* — Robert S Walters, Jr.
(74) *Attorney, Agent, or Firm* — Davidson, Davidson & Kappel, LLC

(57) ABSTRACT

A coating method for producing an electrically insulating coating on a bearing component, wherein, in a first step, a substance mixture comprising at least a) a silane and/or siloxane compound, b) a metal alcoholate, and c) PEEK and/or PTFE in the form of a dispersion is applied to the bearing component and, in a second step, is solidified on the component surface by means of a laser beam.

13 Claims, No Drawings

COATING METHOD AND COATING FOR A BEARING COMPONENT

The present invention relates to a coating, and to a corresponding coating.

BACKGROUND

For the purpose of electrical insulation and/or of improvement in their tribological properties, components, more particularly bearing components, for which the tribological properties are particularly important, are provided with specific coatings. For the purpose of electrical insulation, it is common to apply thick ceramic spray coats to the components.

A problem with the typical thick ceramic coats is that in certain cases these coats are of only limited suitability, or completely unsuitable, for bearing components. More particularly there is to date no known coating which alongside good electrical insulation properties does justice simultaneously to the exacting requirements of the capacity to withstand a rolling load—which in the case of some bearing components is a prerequisite. In general, furthermore, the thick ceramic layers require subsequent machining and have a relatively high mass. The ceramic layers, furthermore, are unsuitable for small bearings with internal diameters of less than 75 mm, since because of the small bearing tolerances these bearings do not allow a thick insulating layer or for reasons of process engineering and/or geometry cannot be equipped with a ceramic spray coating. An alternative coating method, with which a PTFE antifriction layer is applied, is known from publication DE 101 47 292 B4, for example.

SUMMARY OF THE INVENTION

The introduction of heat into the components, that is associated with the coating method, may be detrimental to the strength of the component. Particularly if the temperatures during the coating method lie above the customary tempering temperatures of the materials, and/or if temperatures are maintained for a long time, this may have consequences for the microstructure of the materials. The introduction of heat may result, for example, in unwanted diffusion effects or grain growth and may thus impair, for example, the results of a hardening procedure carried out on the component beforehand.

It is an object of the present invention to provide a coating method and a corresponding coating that allow an electrically insulating coating, which at the same time has the capacity to withstand a rolling load, to be applied to a component with as little introduction of heat as possible.

Proposed in accordance with the invention for the purpose of achieving the object is a coating method for producing an electrically insulating coating on a bearing component, where in a first step a composition which comprises at least a) a silane and/or siloxane compound, b) a metal alkoxide, and c) PEEK and/or PTFE as dispersion is applied to the bearing component and in a second step is consolidated by a laser beam on the surface of the component. The laser in question here is preferably a pulsed laser.

Preferably, in an intermediate step, located temporally between the first step and the second step, the composition is dried at a temperature in a range between 100 and 200° C. Further preferred is drying in a range between 120 and 150° C.

The composition preferably further comprises an organic colorant, the organic colorant preferably containing carbon black or being configured in the form of carbon black.

The applied composition preferably has a thickness which is at least twice the wavelength of the laser beam used.

The method is preferably carried out under inert gas atmosphere or vacuum. This allows unwanted instances of scaling or oxidation of the applied coating to be avoided.

The temperature during the method preferably does not exceed the customary tempering temperature of the material of the bearing component. By means of a low level of heat introduction it is possible in principle to minimize adverse changes to the base material, with the tempering temperature representing a limiting temperature on exceedance of which the risk exists that the microstructure of the material of the bearing component will be altered.

The coating method is preferably used to apply a coating 1 to 10 μm thick to the bearing component.

For the purpose of achieving the object, additionally proposed is a coating which has been produced in accordance with the coating method of the invention described. The described composition of the coating may preferably further comprise an organic polymer obtained by polymerization of olefinically unsaturated monomers.

The silane and/or siloxane compound is further configured preferably as an acyloxysilane, alkylsilane, aminosilane, bis-silyl-silane, epoxysilane, fluoro-alkylsilane, glycidyloxysilane, isocyanato-silane, mercapto-silane, (meth) acrylato-silane, mono-silyl-silane, multiple-silyl-silane, sulfur-containing silane, ureidosilane, or vinylsilane, and/or as a corresponding siloxane.

The composition and/or the coating preferably further comprises a solvent mixture comprising organic solvent.

The composition and/or the coating preferably further comprises a surfactant comprising, preferably, wetting agents and/or deaerating agents and/or defoamers.

The carbon layers used to date for roller bearings have metallic elements (identified as a-C:Me); these layers, though having outstanding tribological properties, are nevertheless electrically conducting on account of the metallic component. Metal-free carbon layers (for example, a-C:H, a-C:H:a, ta-C:H, ta-C) have very good tribological antifriction properties, but do not withstand the mechanical stresses which occur in roller bearings.

As a result of the coating method of the invention and/or of the coating of the invention it is possible to combine outstanding tribological properties with simultaneous mechanical strength and electrical insulation in one coat, without the base material being adversely affected by the introduction of temperature during the coating procedure.

After the coating method, the coating produced preferably has a thickness in a range between 1 to 10 μm, more preferably in a range between 1 to 4 μm. These relatively thin layers are highly suited to components for which there are exacting requirements in terms of component tolerances, and are applied preferably to roller bearing components made from inexpensive steels such as 16MnCr5, C45, 100Cr6, 31CrMoV9, or 80Cr2.

As a result of the coating of the invention, there is virtually no change in the dimensions and surface roughnesses; the tribological properties can be improved, and at the same time the mechanical stresses can be taken into account. Preferably, a polymeric dispersion comprising PEEK and metal alkoxides, a so-called sol-gel layer, is sintered by means of a pulsed diode laser or carbon dioxide laser. Sintering takes place preferably after drying of the solvent in the applied coating.

The use of laser beams allows polymeric particles to be sintered in the milliseconds and nanoseconds range. The sintering time is dependent on the size of the treatment area, and is less than one minute. With the laser beam, extremely steep temperature gradients are produced, which penetrate into the substrate to a depth of only a few micrometers and thus do not adversely affect the base material. The shock heating produced by a pulse of laser light causes thermoelastic effects which excite a broad spectrum of ultrasound waves. This effect leads specifically to the further compaction of the sintered layer, allowing production of dense and pore-free layers from mixtures of PEEK with aluminum oxide, zirconium oxide, silicon oxide, and titanium oxide. The depth to which the laser beam penetrates the surface ranges within from one up to approximately twice its wavelength. The polymeric dispersion layer to be sintered is therefore preferably at least twice as thick as the wavelength of the laser beam used. This can be achieved by drying the produced polymeric dispersion layer at a temperature of preferably 120 to 150° C. This polymeric dispersion may be colored—as already described—by means of an organic colorant, so that the incident laser radiation is absorbed optimally in the dispersion layer.

The dispersion coating procedure preferably used is one in which polymeric particles, an organic-inorganic hybrid coating, usually in solution in organic solvent and/or in water, are applied by means of a print coating method (or another coating method such as dipping, spraying, rolling, or the like) in the form of a very thin dispersion coating on the region of the surface that is to be coated.

With regard to the development of the polymeric coating, which is preferably also applied in the form of dip coating, particular requirements are imposed on the dispersion. In particular, account must be taken of the corrosion resistance of the materials to be coated, which is low in some cases (particularly in the case of steels) with regard to the composition of the dispersion, the cleaning of the substrate, and the heat treatment of the layer.

Further advantages, features, and details of the invention will become apparent from the description below of a working example.

In this working example, a polymeric PEEK layer with outstanding tribological properties, in tandem with high mechanical strength and electrical insulating properties, is produced on a bearing component by means of a laser coating method.

A coating 1 to 10 μm thick is applied to a bearing component—for example, a roller bearing made from an inexpensive steel such as 16MnCr5, C45, 100Cr6, 31CrMoV9, or 80Cr2. This involves a polymeric dispersion comprising PEEK and metal alkoxides (the sol-gel layer) being converted by laser beam sintering into a hard coating. Through the technique of laser sintering it is possible to apply polymers with high melting points, such as polyetherketones, to substrates having relatively low melting temperatures. The sintered layers contract preferably to a maximum layer thickness of 1 to 4 μm.

In the case of another preferred procedure, the dispersion-based coating material is subjected to preliminary thermal drying using IR radiation. This makes the coating material into an organic-inorganic hybrid layer still in powder form, similar to a conventional, highly filled coating material with a low binder content and with a weak binding character to the substrate surface. This layer is then subjected to further, higher thermal drying, at temperatures up to 400° C., in the course of which the powdery character is continuously lost. The organic constituents of the layer begin to melt, and ultimately this sintering procedure produces a visually homogeneous polymeric film having a uniformly smooth and pore-free surface.

Another possible way of producing a polymeric layer is to use aqueous suspensions of hard substance. In this case mixing takes place into a suspension of hard substance with a microscale polymeric powder, affording the opportunity to produce extremely abrasion-resistant coatings. Abrasion-resistant coatings of this kind can be produced, for example, through the dispersing of silicon dioxide (DEGUSSA, Aerosil OX50) with polymeric particles (polyetherketone from Vitrex) in water. These layers can be melted directly after drying (IR drying) by the solvent and the subsequent pulsed magnetic induction of the metallic substrate. Through the technique it is possible to apply polymers of high melting point, such as polyetherketones, to the substrate to be coated, from the powder form, within seconds, to form a polymeric film.

In preparation, the components are cleaned. This can be done without problem by reverting to methods that are customary in industrial practice, examples being hot degreasing baths with surfactants and temporary corrosion control. In spite of the temporary corrosion control, as in the case, for example, of monoethanolamine (MEA), which remains on the component after cleaning, there is no adverse effect on the dispersion-based coating deposited.

Preference is given to the use of a carbon-dioxide laser system having one or more of the following properties:

- 1.6 kW carbon dioxide laser
- Substrate size up to 400×600 $mm^2$
- Beam spot size from 0.8 to 10 mm
- 2-axis scanner system (up to 250 Hz)
- 4 CNC axes
- Variable atmosphere
- Temperature control via pyrometer (focus measurement or line measurement)

Preference is given to using a diode laser sintering system having one or more of the following properties:

- Minimum beam diameter: $d_b \approx 0.37$ mm (f=100 mm)
- Pulse lengths: $t_p$=0.45 to 19.25 μs
- Pulse intensity IP≈4·105 W/$cm^2$
- Maximum output power at I=120 A: about 100 W
- Target temperature: about 400° C.
- Temperature fluctuation: about 5%
- Maximum advancement speed: 40 mm/s
- Interaction time: 2 to 3 ms
- Thermal penetration depth: about 50 to 100 μm A carbon dioxide laser which is operated in a range between 20 to 40 W preferably has an advancement speed in a range between 45 to 55 mm/s and a thermal penetration depth in a range between 0.08 to 0.12 mm.

The PEEK dispersion is preferably baked on bearing components made of hardened steel, with the production of an extremely hard polymeric layer being achieved by means of pulsed laser preferably at a sintering temperature below the customary tempering temperatures of 180 to 220° C. The use of the laser opens up the possibility of adapting local properties of the material, both mechanically and tribologically, to the requirements in situ. Preferred for this purpose is the use of partially pulsed laser beams. With further preference, the laser beam sintering may also take place by pulsewise microwave or induction assistance.

In the course of the development of the method, an investigation was made into the interactions of laser radiation at different wavelengths with different constituents of the sol-gel coating, leading to the desired ceramic layers on steel.

Through the use of the broad-spectrum absorber carbon black, it was possible for the method of the invention to be applied to different sintering systems with different lasers. Examples thereof are HeNe lasers with emission wavelengths at 632.8 nm red, krypton ion lasers, a plurality of lines at 350.7 nm; 356.4 nm; 476.2 nm; 482.5; 520.6 nm, 530.9 nm; 586.2 nm; 647.1 nm; 676.4 nm; 752.5 nm; 799.3 nm (blue to deep red), and neodymium lasers (YAG (yttrium-aluminum-garnet) crystal and emits infrared radiation with the wavelength 1064 nm and also 532 nm), and also a diode laser of 980 nm, 1480 nm, and 1920 nm wavelength.

For the preparation of the organic-inorganic hybrid polymers, the starting chemicals used are similar to those also employed for the sols for deposition of green ceramic oxide layers. In this working example, the polymeric dispersion is prepared from PEEK and metal alkoxides (sol-gel). Metal alkoxides are organic compounds in which a plurality of alcohol residues are attached to a metal ion via the oxygen atoms of an alkyl group. They are prepared by the reaction of elemental metals with alcohols, with elimination of hydrogen. Metal ions contemplated are silicon, titanium or zirconium for a tetravalent metal, and aluminum, yttrium or boron for a trivalent metal.

Metal alkoxides are extremely reactive—the alkoxides are able to react, for example, with water or organic compounds. In the course of such reaction, the alcohol residues are eliminated. The reaction with organic compounds is utilized in order to prepare sols with polymeric structures. The reaction with water, furthermore, is to be avoided. Metal alkoxides are very readily hydrolyzable, and so even small amounts of water may lead to the uncontrolled precipitation of macromolecular metal hydroxide particles. An organic compound, such as acetic acid, glycine, and aminocaproic acid, for example, which is added to the alkoxide prior to the hydrolysis, prevents the metal alkoxide complex from undergoing complete hydrolysis and precipitating in the form of a hydroxide; in this way, the alkoxide can be stabilized. Acetic acid stabilized alkoxides have significantly shorter gel times than alkoxides stabilized with other acids. While the lower acidity of acetic acid in alcohol does retard the hydrolysis, it nevertheless accelerates the condensation to such a great extent that the overall reaction proceeds more rapidly. These partially hydrolyzed metal alkoxides are then able to polymerize with one another. There is formation of chains, depending on the stabilization, and of three-dimensional networks. Water produced as a result of the reaction may provide for further hydrolysis.

Besides metal alkoxides, organically modified silanes (ORMOSILs) are also preferably employed. As further silane, 3-aminopropyltriethoxysilane, alkoxysilane, alkoxy-functional organopolysiloxanes, and glycol-functional organosilicon compounds are used, which are known as adhesion promoters for metals, silicate glasses, and oxidic materials. For the sol synthesis, use is made, as well as the simple alkoxides, such as tetraethoxyorthosilane (TEOS), for example, of network-modifying and also network-forming ORMOSILs. The TEOS is utilized for the production of stable, dense oxide layers. By virtue of these dense oxide layers, TEOS has a poor electrical conductivity and has an insulating effect and is used, accordingly, as a protective oxide. Since TEOS also contains silicon, the oxide layer to be applied grows linearly and with great rapidity. In the course of sintering, the ethyl group is eliminated, and a ceramic layer with pure silicon dioxide is formed.

One of the most simple network-modifying ORMOSILs is methyltriethoxysilane (MTES). In addition to the three epoxy groups, which crosslink through polycondensation, it contains a methyl group, which remains chemically inert and thus reduces the degree of crosslinking in the gel. A typical network-forming ORMOSIL is methacryloyloxypropyltrimethoxysilane (MATMS). The organic crosslinking here takes place via a methacryloyl group. Known and preferred metals, besides silicon, include aluminum, titanium, and zirconium, though many others are also conceivable. One possibility of application of the method is shown by the onward development of the MTES/TEOS sols in conjunction with organically modified zirconium, in which case the sol ought to be made alkaline. These preferred sols have excellent coating characteristics. Even at critical locations, such as edges of the component, the coating features reduced susceptibility to cracking The preferred particle size distribution of a polymeric, base-catalyzed, silicon dioxide sol and of a colloidal, acid-stabilized, aluminum oxide sol is situated in a range between 80 and 100 nm. The use of acid catalysis for the silicon dioxide sol leads to small particles, and of base catalysis to large particles. It has been found that under the selected conditions, in the pH range of the polymeric dispersion between pH 0 and 2, the equilibrium of the hydrolysis—condensation reactions is situated on the side of the hydrolysis; in other words, structures with a high degree of hydrolysis and low degree of condensation are formed. At pH levels from 2 to 5, the condensation is the rate-determining step. Monomers and smaller oligomers with reactive silanol groups are present alongside one another. Further condensation leads to a relatively weakly crosslinked network with small cagelike units. Under comparable conditions in the alkaline pH range, the equilibrium is situated on the side of the condensation; in other words, after slow formation of hydrolysis species, there is immediate onset of the condensation reaction, thus forming separate, highly crosslinked polysiloxane units. In a basic environment, the hydrolysis is rate-determining. The clusters grow primarily through condensation with monomers. This results in networks with large particles and pores. For the sol-gel process with base catalysis, preference is given to using sodium hydroxide or ammonia. The result here in principle is a dependency of the reaction rate on the strength of base that is analogous to the dependency on the strength of acid in the case of acid catalysis.

Wide-ranging coating experiments have shown that the structure of the condensates formed is dependent not only on the pH of the reaction medium but also on the nature of the solvent, the nature and chain length of the alkoxy function, on the molar Si/water ratio, on the concentrations, the temperature, the nature and concentration of the catalyst, evaporation rates, and the amount of water added.

Described in the literature are preparations with molar water/silicon ratios (r) of from 1 to 50. An increasing molar ratio r significantly accelerates the acid-catalyzed hydrolysis and leads to a greater number of SiOH groups, thereby facilitating the formation of cyclic structures in the sol. The competing condensation reactions as well are critically dependent on the concentration of water, since with $r<2$ the condensation with elimination of alcohol is predominant, and with $r>2$ the condensation with elimination of water is predominant. If the water concentration is high, dilution effects occur, leading to a delay in the hydrolysis and condensation reactions. Viscous, spinnable sols are obtained at a preferred molar ratio of Si(OR)4 to water of from 1:1 to about 1:2. Further preferred are ratios from 1:4 to 1:11, since they allow the production of layers with low susceptibility to cracking If the excess of water relative to TEOS is increased further, the results are monolithic solid bodies, which should be avoided. Generally speaking, the same fundamental reaction profile arises for all catalysts, but the rates change depending on the strength and concentration of the catalyst. It has been discovered that this effect can be attributed to differences in the dissociation behavior and hence to the pH.

Further results of experiments into the contraction behavior of both preferred gels during sintering show that acid catalysis of the silicon dioxide sols leads to rapid contractions, and base catalysis to time-delayed contractions. Through the combination of network-forming and network-modifying ORMOSILs and also pure metal alkoxides in the polymeric dispersions, it is possible to produce very varied hybrid layers. These layers of the invention are distinguished by innovative properties, since here, at a molecular level, there is a mixture of inorganic metal oxide bridging bonds and organic bonds via hydrocarbon chains in a polymeric matrix. Ceramic layers may be made available both for mechanical requirements and for functional requirements. The chemical composition of the sol, the conditions of layer deposition, and the heat treatment parameters, such as heating rate, temperature, and holding duration, all influence the properties of the layer.

By means of the described layer construction of polymeric layers with embedded metal oxides it is possible to combine the outstanding tribological properties with mechanical strength and electrical insulation, thereby giving rise to the advantages already described. Since the coating can be used without subsequent work, as a result of the high mechanical strength and the low layer thickness, any costs for subsequent working are removed. Through the outstanding tribological properties it is possible to use more cost-effective and also less viscous lubricants, featuring lower internal frictions, and oil change intervals can be extended. In addition, roller bearing components can be operated even under dry friction and depleted lubrication, since the PTFE dispersion used with preference acts as a dry lubricant. In place of PTFE, it is also possible for similar, equivalent dry lubricants with low coefficients of friction to be used; the core of the invention is unaffected by this.

The layers, additionally, have just as good a thermal stability, of around 350 to 380° C., as the a-C:H:Me layers referred to at the outset, endowing them with a significantly greater field of use. The possibility, resulting from the invention, of using hydraulic oil, diesel fuel, water or even petroleum as lubricant, opens up entirely new fields of use in the food industry, productronics, drive technology, and also hydraulic and other media-lubricated applications.

The invention claimed is:

1. A coating method for producing an electrically insulating coating on a bearing component, comprising:

applying in a first step a composition including at least: a) a silane and/or siloxane compound, b) a metal alkoxide, and c) polyether ether ketone or polytetrafluoroethylene as a dispersion to a surface of the bearing component; and consolidating the composition in a second step by a laser beam to form an electrically-insulating layer on the surface of the component.

2. The coating method as recited in claim 1 further comprising drying in an intermediate step, located temporally between the first step and the second step, the composition at a temperature of between 100 and 200° C.

3. The coating method as recited in claim 1 wherein the composition further comprises an organic colorant.

4. The coating method as recited in claim 3 wherein the organic colorant comprises carbon black.

5. The coating method as recited in claim 1 wherein the applied composition has a thickness at least twice a wavelength of the laser beam used in the second step.

6. The coating method as recited in claim 1 wherein the first and second steps are carried out under inert gas atmosphere or vacuum.

7. The coating method as recited in claim 1 wherein a temperature during the first and second steps does not exceed a tempering temperature of a material of the bearing component.

8. The coating method as recited in claim 1 wherein the coating method is used to apply a coating 1 to 10 μm thick to the bearing component.

9. The coating method as recited in claim 1 wherein the first step forms a sol-gel layer.

10. The coating method as recited in claim 1 wherein the electrically-insulating layer is pore free.

11. The coating method as recited in claim 1 wherein the silane and/or siloxane compound is an acyloxysilane, alkylsilane, aminosilane, bis-silyl-silane, epoxysilane, fluoroalkylsilane, glycidyloxysilane, isocyanato-silane, mercaptosilane, (meth)acrylato-silane, sulfur-containing silane, ureidosilane, or vinylsilane, and/or a corresponding siloxane.

12. The coating method as recited in claim 1 wherein the silane and/or siloxane compound is an organically modified silane.

13. The coating method as recited in claim 12 wherein the organically modified silane is one of tetraethoxyorthosilane, methyltriethoxysilane or methacryloyloxypropyltrimethoxysilane.

* * * * *